US005581045A

United States Patent [19]

Peers, Jr.

[11] Patent Number: 5,581,045

[45] Date of Patent: Dec. 3, 1996

[54] METHOD AND INTEGRATED CIRCUIT FOR THE FLEXIBLE COMBINATION OF FOUR OPERATORS IN SOUND SYNTHESIS

[75] Inventor: Roi N. Peers, Jr., Livermore, Calif.

[73] Assignee: ESS Technology, Inc., Fremont, Calif.

[21] Appl. No.: 305,099

[22] Filed: Sep. 13, 1994

[51] Int. Cl.[6] ..... G10H 5/00

[52] U.S. Cl. ..... 84/647; 84/660; 84/663

[58] Field of Search ..... 84/625, 647, 648, 84/658–660, 663, 675–677, 697, 698

[56] References Cited

U.S. PATENT DOCUMENTS

| | | | |
|---|---|---|---|
| 4,018,121 | 4/1977 | Chowning | 84/659 X |
| 4,133,241 | 1/1979 | Niimi . | |
| 4,173,164 | 11/1979 | Adachi . | |
| 4,249,447 | 2/1981 | Tomisawa . | |
| 4,253,367 | 3/1981 | Hiyoshi . | |
| 4,297,933 | 11/1981 | Nishimoto . | |
| 4,301,704 | 11/1981 | Nagai . | |
| 4,406,204 | 9/1983 | Katoh . | |
| 4,422,362 | 12/1983 | Chibana . | |
| 4,455,911 | 6/1984 | Yamada . | |
| 4,554,857 | 11/1985 | Nishimoto . | |
| 4,616,546 | 10/1986 | Uchiyama . | |
| 4,643,066 | 2/1987 | Oya . | |
| 4,644,839 | 2/1987 | Nishimoto . | |
| 4,655,115 | 4/1987 | Nishimoto . | |
| 4,747,332 | 5/1988 | Uchiyama . | |
| 4,748,888 | 6/1988 | Oya . | |
| 4,766,795 | 8/1988 | Takeuchi . | |
| 4,788,896 | 12/1988 | Uchiyama . | |
| 4,813,326 | 3/1989 | Hirano . | |
| 4,875,400 | 10/1989 | Okuda et al. | 84/626 |
| 4,942,799 | 7/1990 | Susuki | 84/603 |
| 5,025,702 | 6/1991 | Oya | 84/659 |
| 5,033,352 | 7/1991 | Kellogg | 84/658 |
| 5,076,133 | 12/1991 | Toda | 84/624 |
| 5,094,136 | 3/1992 | Kudo | 84/603 |
| 5,138,924 | 8/1992 | Ohya | 84/604 |
| 5,182,415 | 1/1993 | Kunimoto | 84/660 |
| 5,191,161 | 5/1993 | Oya . | |
| 5,198,604 | 3/1993 | Higashi et al. | 84/626 |
| 5,218,156 | 6/1993 | Ilzuka | 84/624 |
| 5,357,575 | 10/1994 | Kitamura | 84/625 X |

*Primary Examiner*—William M. Shoop, Jr.
*Assistant Examiner*—Jeffrey W. Donels
*Attorney, Agent, or Firm*—Law Offices of Thomas E. Schatzel A Prof. Corporation

[57] ABSTRACT

A four-operator sound synthesis integrated circuit comprises a first through a fourth sound synthesis operator, a first programmable multiplier connecting the output of the first operator to the input of the second operator, a second programmable multiplier connecting the output of the second operator to the input of the third operator, a third programmable multiplier connecting the output of the third operator to the input of the fourth operator, a fourth programmable multiplier connecting the output of the first operator a first input of a four-input adder, a fifth programmable multiplier connecting the output of the second operator a second input of the four-input adder, a sixth programmable multiplier connecting the output of the third operator a third input of the four-input adder, and a seventh programmable multiplier connecting the output of the fourth operator a fourth input of the four-input adder. The product of the combination is taken from the output of the four-input adder. Each programmable multiplier can be programmed to multiply from zero to one, e.g., zero, one-half, and one.

7 Claims, 2 Drawing Sheets

METHOD AND INTEGRATED CIRCUIT FOR THE FLEXIBLE COMBINATION OF FOUR OPERATORS IN SOUND SYNTHESIS

RELATED APPLICATION

A copending application, Ser. No. 08/305,087 filed Sep. 13, 1994, entitled, METHOD AND INTEGRATED CIRCUIT FOR ELECTRONIC WAVEFORM GENERATION OF VOICED AUDIO TONES, is incorporated herein by reference.

1. Field of the Invention

The present invention relates generally to electronics devices, and more particularly to waveform synthesizers for the generation of voiced musical and electronic tones.

2. Description of the Prior Art

Musical instruments each have characteristic voices that relate to the sound amplitude envelope attack rate, decay rate, sustain level and release rate. For example, the envelope of piano sounds has a sharp attack rate when the keys are pressed and then gradually diminishes as the key is held down. By pressing a piano's sustain pedal, the sound will fade away slower. A piano also has a large number of harmonic overtones during the attack. These harmonic overtones decrease over time until a near constant harmonic content results.

Frequency modulation (FM) techniques are conventionally employed in audio sound synthesis digital integrated circuits to generate complex waveforms that contain high harmonic and non-harmonic sounds. The correspondence between the modulation index and spectrum distribution of higher harmonics is-natural and makes possible a wide range of sound generation. FM sound generation uses effects obtained from modulating a carrier. The pitch, tone and level of a musical sound can be obtained by skillful manipulation of basic FM parameters, e.g., carrier output level, modulator output level, feedback level of the modulator, frequency of the carrier and frequency of the modulator.

Conventional approaches to tone synthesis are described by Nishimoto in U.S. Pat. Nos. 4,297,933, ELECTRONIC MUSICAL INSTRUMENT FOR TONE FORMATION BY SELECTABLE TONE SYNTHESIS COMPUTATIONS, and 4,554,857, ELECTRONIC MUSICAL INSTRUMENT CAPABLE OF VARYING A TONE SYNTHESIS OPERATION ALGORITHM, and by Hiyoshi in U.S. Pat. No. 4,253,367, MUSICAL TONE FORMING DEVICE BY FM TECHNOLOGY.

John Chowning, U.S. Pat. No. 4,018,121, issued Apr. 19, 1977, describes basic FM synthesis for musical sounds, e.g., a modulating sine wave, a time varying envelope function for the modulating waveform, a carrier sine wave, and a time varying envelope function for the amplitude of the frequency modulated wave. The amplitude of the modulating wave, or the envelope function for the modulating wave, varies with time so that the frequency spectrum of the resulting frequency modulated waveform varies during the attack, sustain, and decay of the sound. It is conventional to use a envelope function to vary the amplitude of the final sound, but Chowning added an envelope function to the modulating waveform to time vary the frequency spectrum of the generated sound.

The Yamaha OPLII allows two operators to be combined such that one modulates the sine wave output of the other and, alternatively for the sine wave outputs of two operators to be combined in an adder. The Yamaha OPLIII model YM262 allows four operators to be combined in any of four ways.

In the first case, the four operators are connected in a string of four, wherein a first (e.g., "A") modulates the sine wave of a second (e.g., "B"), which modulates the sine wave of a third (e.g., "C"), which modulates the sine wave of a fourth (e.g., "D"), which is then output. The output ("Q(t)") of this first combination can be expressed mathematically as shown in equation (1), $$I_3\sin(w_3t+I_2\sin(w_2t+I_1\sin(w_1t+I_0\sin(w_0t)))). \quad (1)$$

In a second case, two operators (e.g., "A" and "C") are respectively connected to modulate the sine waves of the other two operators (e.g., "B" and "D") and the two strings are then combined in an adder. The output ("Q(t)") of this second combination can be expressed mathematically as shown in equation (2), $$I_3\sin(w_3t+I_2\sin(w_2t)\ )+I_1\sin(w_1t+I_0\sin(w_0t)). \quad (2)$$

In a third case, a first operator (e.g., "A") is added to the output of a string of three other operators (e.g., "B", "C" and "D"). The output ("Q(t)") of this third combination can be expressed mathematically as shown in equation (3), $$I_3\sin(w_3t+I_2\sin(w_2t+I_1\sin(w_1t)))+I_0\sin(w_0t). \quad (3)$$

In a fourth case, a first operator (e.g., "A") is added to both the output of a string of two other operators (e.g., "B" and "C") and a fourth operator (e.g., "D"). The output ("Q(t)") of this third combination can be expressed mathematically as shown in equation (4), $$I_3\sin(w_3t)+I_2\sin(w_2t+I_1\sin(w_1t))+I_0\sin(w_0t). \quad (4)$$

The conventional method of combining such operators includes using multiplexers to switch some of the inputs and outputs of the four operators into the four configurations represented by formulas (1)–(4). A more flexible method of combining four operators is needed to better utilize the sound synthesis capabilities of four operators.

SUMMARY OF THE INVENTION

It is therefore an object of the present invention to provide a method of utilizing four operators for sound synthesis.

It is a further object of the present invention to provide an electronic circuit that implements a single master algorithm with sufficient input parameters to represent substantially all desirable tone formulas.

Briefly, a four-operator circuit embodiment of the present invention comprises a first through a fourth sound synthesis operator, a first programmable multiplier connecting the output of the first operator to the input of the second operator, a second programmable multiplier connecting the output of the second operator to the input of the third operator, a third programmable multiplier connecting the output of the third operator to the input of the fourth operator, a fourth programmable multiplier connecting the output of the first operator a first input of a four-input adder, a fifth programmable multiplier connecting the output of the second operator a second input of the four-input adder, a sixth programmable multiplier connecting the output of the third operator a third input of the four-input adder, and a seventh programmable multiplier connecting the output of the fourth operator a fourth input of the four-input adder. The product of the combination is taken from the output of the four-input adder. Each programmable multiplier can be programmed to multiply from zero to one, e.g., zero, one-half, and one.

An advantage of the present invention is that a tone generator is provided that generates substantially all desired tone formulas with a single circuit.

Another advantage of the present invention is that a method is provided for time-varying multiplication factors which permit the tone color to be modified during the tone generation.

These and other objects and advantages of the present invention will no doubt become obvious to those of ordinary skill An the art after having read the following detailed description of the preferred embodiment which is illustrated in the various drawing figures.

IN THE DRAWINGS

FIG. 1 is block diagram of a tone generator system with four operators similar to that illustrated in FIG. 2; and FIG. 2 is a schematic diagram of a typical operator.

DETAILED DESCRIPTION OF THE PREFERRED EMBODIMENT

Figure 1:
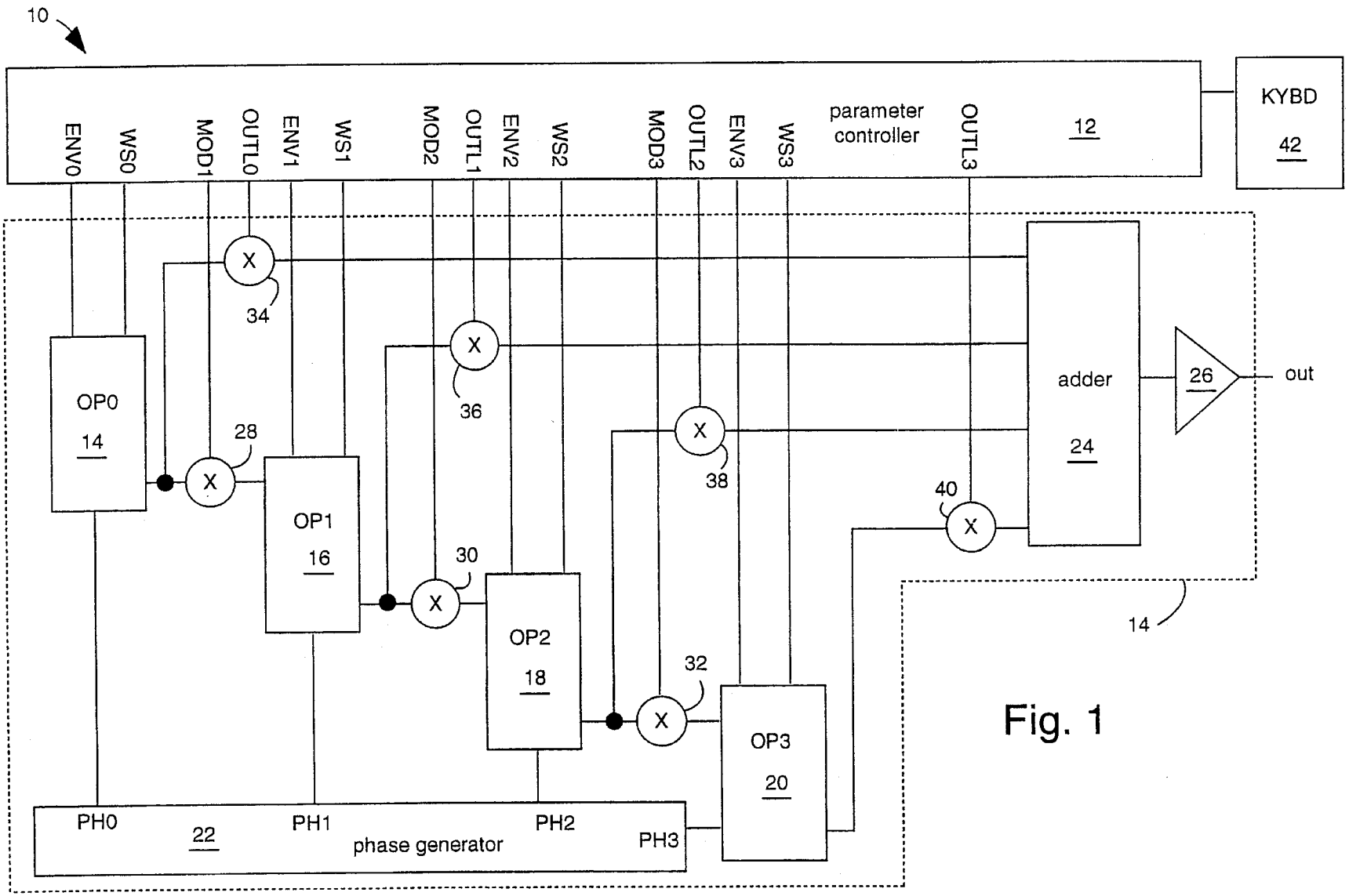

In FIG. 1, a tone generator system 10 comprises a parameter controller (PC) 12 connected to a tone synthesizer circuit 13. The tone synthesizer circuit 13 comprises several functions that may be implemented either as hardware or software. The illustration of the tone synthesizer circuit 13 in FIG. 1 therefore represents a flowchart in the case of software and a functional block diagram in the case of hardware. The tone synthesizer circuit 13 is capable of producing an output signal "Q(t)", mathematically represented by equation (5), $$A_3I_3\sin(w_et + B_2I_2\sin(w_2t + B_1I_1\sin(w_1t + B_0I_0\sin(w_0t)))) + A_2I_2\sin(w_2t + B_1I_1\sin(w_1t + B_0I_0\sin(w_0t))) + A_1I_1\sin(w_1t + B_0I_0\sin(w_0t)) + A_0I_0\sin(w_0t). \quad (5)$$

The tone Synthesizer circuit 13 is capable of a four-operator computation and comprises a first operator (OP0) 14, a second operator (OP1) 16, a third operator (OP2) 18, a fourth operator (OP3) 20, a phase generator 22, a four-input adder 24 and an output amplifier 26. Although four individual hardware operators (14, 16, 18 and 20) are illustrated in FIG. 1, a single time-shared operator can also provide good results. A multiplier 28 (represented by "$B_0$" in equation (5)) connects the output of OP0 14 to the input of OP1 16 and is controlled by a signal MOD1 from the PC 12. A multiplier 30 (represented by "$B_1$" in equation (5)) connects the output of OP1 16 to the input of OP2 18 and is controlled by a signal MOD2 from the PC 12. A multiplier 32 (represented by "$B_2$" in equation (5)) connects the output of OP2 18 to the input of OP3 20 and is controlled by a signal MOD3 from the PC 12. The output of OP0 14 is connected through a multiplier 34 (represented by "$A_0$" in equation (5)) controlled by a signal OUTL0 from PC 12 and out to the four-input adder 24. The output of 0P1 16 is connected through a multiplier 36 (represented by "$A_1$" in equation (5)) controlled by a signal OUTL1 from PC 12 and out to the four-input adder 24. The output of OP2 18 is connected through a multiplier 38 (represented by "$A_2$" in equation (5)) controlled by a signal OUTL2 from PC 12 and out to the four-input adder 24. The output of OP3 20 is connected through a multiplier 40 (represented by "$A_3$" in equation (5)) controlled by a signal OUTL3 from PC 12 and out to the four-input adder 24.

The configuration of the multipliers 28, 30, 32, 34, 36, 38 and 40 allows a great deal of flexibility in the mixing and weighting of the various operators 14, 16, 18 and 20 in the final calculation that appears at the output of the amplifier 26.

Each of the modulation multipliers 28, 30 and 32 and each of the output multipliers 34, 36, 38 and 40 is connected to receive control signals from the parameter controller that range from zero to one. The multipliers can be implemented in a number of different ways, e.g., Booth algorithm, Wallace tree, and by adding in the log domain.

The parameters used to control each multiplier can be time-varying, in order to create tone color changes within a note. For example, the parameters can be ramped in such a way that a slide between an equation (1) tone and an equation (2) tone is generated in order to transition the tone color between the attack and the sustain of the note. It is also useful to control the multipliers proportional to the velocity and/or pressure that a musician uses on a key at a keyboard 42 connected to the PC 62.

Musical and electronic sound and tones represented by equations (1)–(4) can be synthesized by the circuit illustrated in FIG. 1 which conforms to equation (5), for example, by setting at PC 12:

| Equation | $A_3$ | $A_2$ | $A_1$ | $A_0$ | $B_2$ | $B_1$ | $B_0$ |
|---|---|---|---|---|---|---|---|
| (1) | 1.0 | 0.0 | 0.0 | 0.0 | 1.0 | 1.0 | 1.0 |
| (2) | 1.0 | 0.0 | 1.0 | 0.0 | 1.0 | 0.0 | 1.0 |
| (3) | 1.0 | 0.0 | 0.0 | 1.0 | 1.0 | 1.0 | 0.0 |
| (4) | 1.0 | 1.0 | 0.0 | 1.0 | 0.0 | 1.0 | 0.0 |

Many more combinations than these four are possible, given the binary combination possibilities for the seven values: $A_3$, $A_2$, $A_1$, $A_0$, $B_2$, $B_1$, and $B_0$. More combinations are also possible by allowing each of the seven values to assume values intermediate to zero and one.

Figure 2:
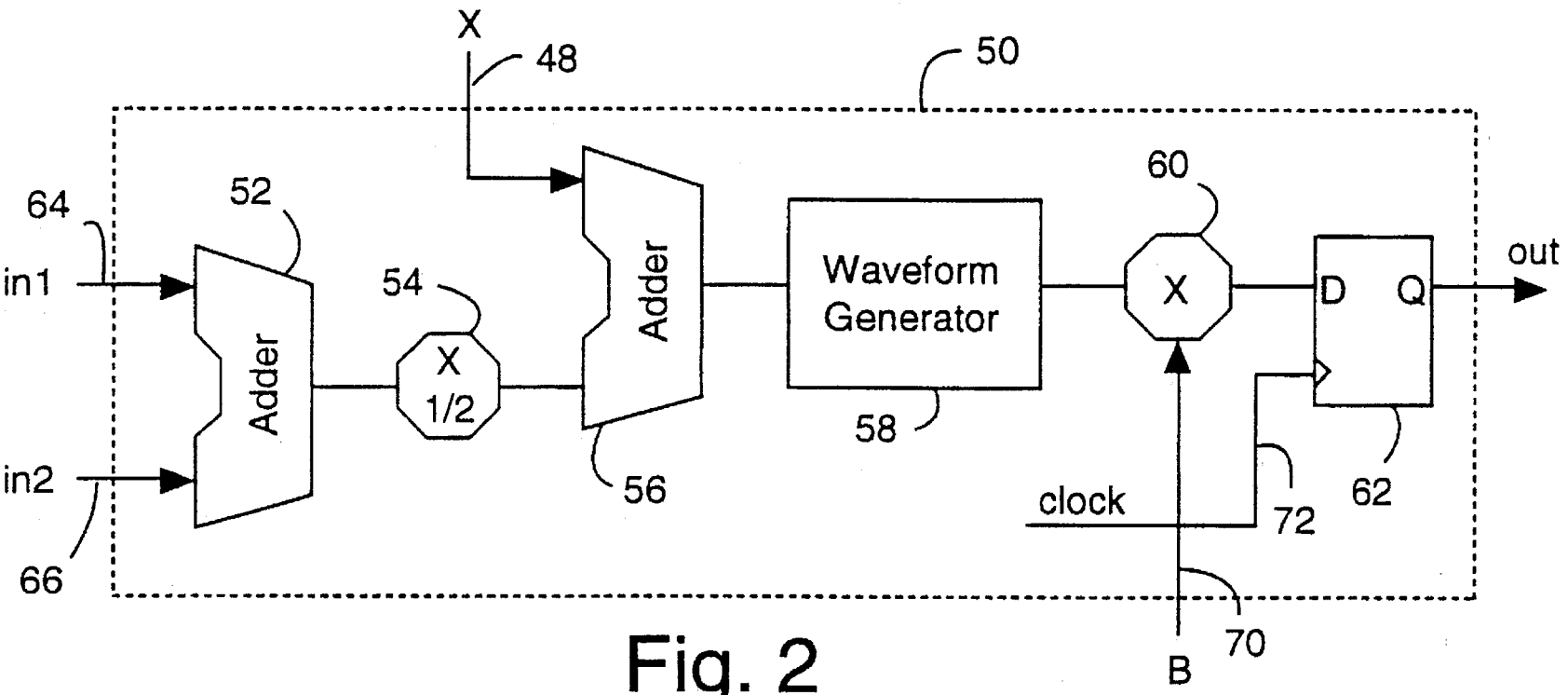

The operators OP0 14, OP1 16, OP2 18 and OP3 20 of FIG. 1 are not limited to the operators illustrated in FIGS. 1 and 2, conventional operators may also be used successfully, and any number of operators may be combined, after the fashion illustrated in FIG. 1, for other tone generation effects.

FIG. 2 illustrates an operator 50 that can be used once for each of operators 14, 16, 18 and 20 of FIG. 1. Alternatively, a single operator 50 may be time-multiplexed to function as all four separate operators 14, 16, 18 and 20. At a minimum, a conventional operator includes an adder, a waveform generator and a multiplier. The operator 50 comprises a first adder 52 connected to a first multiplier 54, a second adder 56, a waveform generator 58, a second multiplier 60 and a latch 62. A bus 64 receives a digital parallel word representing an input (in1). A bus 66 receives another digital parallel word representing a second input (in2). Each bus 64 and 66 is typically twelve bits wide, although other word widths are just as acceptable. A twelve bit, for example, addition results from operation of the first adder 52 that is multiplied by half by the first multiplier 54. Shifting a digital word one bit toward the least significant bit will effectuate a multiplication by one-half (divide by two). A bus 68 is used to input a digital parallel word representing an address phase to the second adder 56. A digital parallel address is output by operation of the second adder 56 to a waveform generator 58.

A read-only memory (ROM) can be used to implement the waveform generator 58. For example, a whole or a part of a pure sinusoidal waveform may be programmed into the ROM such that an input address "y" results in a digitally represented output value "sin y". Alternatively, the waveform generator may comprise Boolean logic to generate the modulating waveform, and not include any memory at all. It has been found to be practical to implement such a non-memory based waveform generator on an integrated circuit using adders and standard cell gate technology. In order to generate all the desirable waveform chords, it is preferable to include in the waveform generator 58 the ability to produce all four quarter phases with quarter phases of sine waves and quarter phases of all zeroes. Then all four quarter phases can be read sequentially to create a full cycle of each desired wave shape.

The parallel digital output word from the waveform generator 58 is applied to the second multiplier 60. For example, the second multiplier 60 may be implemented with an adder in the log domain or a shifter that shifts the digital output word from the waveform generator 58, left or right, by a number of bits as controlled by the digital parallel word representing a common multiplication factor (B) on a bus 70. A clock line 72 causes calculations performed asynchronously to be synchronously clocked out through the latch 62 once each period. This arrangement, which is similar to a state-machine, allows the calculated results of a prior stage to settle before being latched, used in the current stage's calculations and then made available to the next subsequent stage on the next clock cycle.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A method of generating complex waveform signals with an adder, a waveform generator, and an envelope multiplier using frequency modulation, comprising the steps of:

multiplying a signal from an output of a first one ($I_0$) of a plurality of sound synthesis operators ($I_0 \ldots I_n$) by a multiplication factor ($B_0$) to produce a signal with a product ($I_0B_0$) for modulating a second one ($I_1$) of said sound synthesis operators ($I_0 \ldots I_n$);

multiplying a signal from an output of said second one ($I_1$) of said sound synthesis operators ($I_0 \ldots I_n$) by a multiplication factor ($B_1$) to produce a product ($I_1B_1$) for modulating an $n^{th}$ one ($I_n$) of said sound synthesis operators ($I_0 \ldots I_n$);

multiplying each of said signal from said outputs of said plurality of sound synthesis operators ($I_0 \ldots I_n$) by a respective plurality of independent multiplication values ($A_0 \ldots A_n$) to produce a plurality of products ($I_OA_0 \ldots I_nA_n$); and adding each of said plurality of products ($I_0A_0 \ldots I_nA_n$) together to produce a complex waveform signal representing a synthesized tone output.

2. The method of claim 1, wherein:

the third step of multiplying each of said signals from said outputs is such that said multiplication values ($A_0 \ldots A_n$) vary with time; and the first and second steps of multiplying signals from an output are such that said multiplication factors ($B_0$ and $B_1$) vary with time.

3. The method of claim 1, wherein:

the third step of multiplying each of said signals from said outputs is such that said multiplication values ($A_0 \ldots A_n$) vary proportional to the velocity or pressure that a musician uses at a keyboard connected to said plurality of sound synthesis operators through a parameter controller; and the first and second steps of multiplying signal from an output are such that said multiplication factors ($B_O$ and $B_1$) vary proportional to the velocity or pressure that a musician uses at said keyboard.

4. A method of generating signals with complex waveforms with four sound synthesis operators, comprising the steps of:

multiplying a signal from an output of a first one ($I_0$) of a plurality four sound synthesis operators ($I_0 \ldots I_3$) by a multiplication factor ($B_0$) to produce a product ($I_0B_0$) for modulating a second one ($I_1$) of said sound synthesis operators ($I_0 \ldots I_3$);

multiplying a signal from an output of said second one ($I_1$) of said plurality four sound synthesis operators ($I_0 \ldots I_3$) by a multiplication factor ($B_1$) to produce a product ($I_1B_1$) for modulating a third one ($I_1$) of said sound synthesis operators ($I_0 \ldots I_3$);

multiplying a signal from an output of said third one ($I_1$) of said plurality four sound synthesis operators ($I_0 \ldots I_3$) by a multiplication factor ($B_2$) to produce a product ($I_2B_2$) for modulating a fourth one ($I_1$) of said sound synthesis operators ($I_0 \ldots I_3$);

multiplying each of said signals from said outputs of said plurality of four sound synthesis operators ($I_0 \ldots I_3$) by a respective plurality of independent multiplication values ($A_0 \ldots A_3$) to produce a plurality of signal products ($I_0A_0$, $I_0A_0$, $I_0A_0$ and $I_3A_3$); and adding each of said plurality of products ($I_0A_0$, $I_0A_0$, $I_0A_0$ and $I_3A_3$) together to produce a complex waveform signal representing a synthesized tone output.

5. The method of claim 4, wherein:

the fourth step of multiplying each of said signals from said outputs is such that said multiplication values ($A_0 \ldots A_n$) vary with time; and the first through third steps of multiplying an output are such that said multiplication factors ($B_0 \ldots B_2$) vary with time.

6. The method of claim 4, wherein:

the fourth step of multiplying each of said signals from said outputs is such that said multiplication values ($A_0 \ldots A_n$) vary proportional to the velocity or pressure that a musician uses at a keyboard connected to said plurality of sound synthesis operators through a parameter controller; and the first through third steps of multiplying signals from an output are such that said multiplication factors ($B_0 \ldots B_2$) vary proportional to the velocity or pressure that a musician uses at said keyboard.

7. A four-operator sound synthesizer, comprising:

a first through a fourth sound synthesis operator;

a first programmable multiplier connecting the output of the first operator to the input of the second operator;

a second programmable multiplier connecting the output of the second operator to the input of the third operator;

a third programmable multiplier connecting the output of the third operator to the input of the fourth operator;

a fourth programmable multiplier connecting the output of the first operator to a first input of a four-input adder;

a fifth programmable multiplier connecting the output of the second operator to a second input of the four-input adder;

a sixth programmable multiplier connecting the output of the third operator to a third input of the four-input adder; and a seventh programmable multiplier connecting the output of the fourth operator to a fourth input of the four-input adder;

wherein, the product of the combination is taken from the output of the four-input adder.

* * * * *